United States Patent [19]

Sando et al.

[11] 4,262,377

[45] Apr. 21, 1981

[54] METHOD OF CONTINUOUSLY EFFECTING THE WET HEAT TREATMENT OF A CLOTH

[75] Inventors: Yoshikazu Sando; Hiroshi Ishidoshiro, both of Wakayama, Japan

[73] Assignee: Sando Iron Works Co., Ltd., Tokyo, Japan

[21] Appl. No.: 81,331

[22] Filed: Oct. 3, 1979

[30] Foreign Application Priority Data

Oct. 16, 1978 [JP] Japan ..... 53/127120
Oct. 16, 1978 [JP] Japan ..... 53/127121

[51] Int. Cl.[3] ..... D06B 3/12

[52] U.S. Cl. ..... 8/149.1; 8/149.3; 68/5 E

[58] Field of Search ..... 8/149.1, 149.3; 68/5 D, 68/5 E

[56] References Cited

U.S. PATENT DOCUMENTS 2,415,379 2/1947 Vieira ..... 68/5 E X

FOREIGN PATENT DOCUMENTS 276696 10/1951 Switzerland ..... 68/5 D
558990 8/1977 U.S.S.R. ..... 68/5 D

*Primary Examiner*—Philip R. Coe

*Attorney, Agent, or Firm*—Toren, McGeady and Stanger

[57] ABSTRACT

For the continuous wet heat treatment in the processing of a cloth comprising transporting the cloth continuously through a plurality of high pressure steamer bodies having different functions and being connected directly with each other under a saturated water vapor at a relatively low temperature of about 130° C. to subject the cloth to different kinds of treatments therein. A plurality of high pressure steamer bodies, which may have different functions, transport a cloth continuously therethrough, the steamer bodies are composed of universal units arranged transversely, provided respectively with a cloth inlet and a cloth outlet situated at the same level and connected directly with each other by joining the cloth inlet and outlet of the adjacent steamer bodies, and with the cloth inlet and the cloth outlet situated at the opposite ends of the combined steam bodies each having a seal mechanism. A modification involves dividing the high pressure steamer bodies into at least one steamer body for preliminary wet heat treatment of a cloth and two or more steamer bodies for final wet heat treatment thereof, and this arrangement is particularly suitable for dyeing a cloth containing polyester fibers by wet heat treatment to render the surface of the cloth rough by the preliminary wet heat treatment.

1 Claim, 3 Drawing Figures

METHOD OF CONTINUOUSLY EFFECTING THE WET HEAT TREATMENT OF A CLOTH

BACKGROUND OF THE INVENTION

Figure 1:
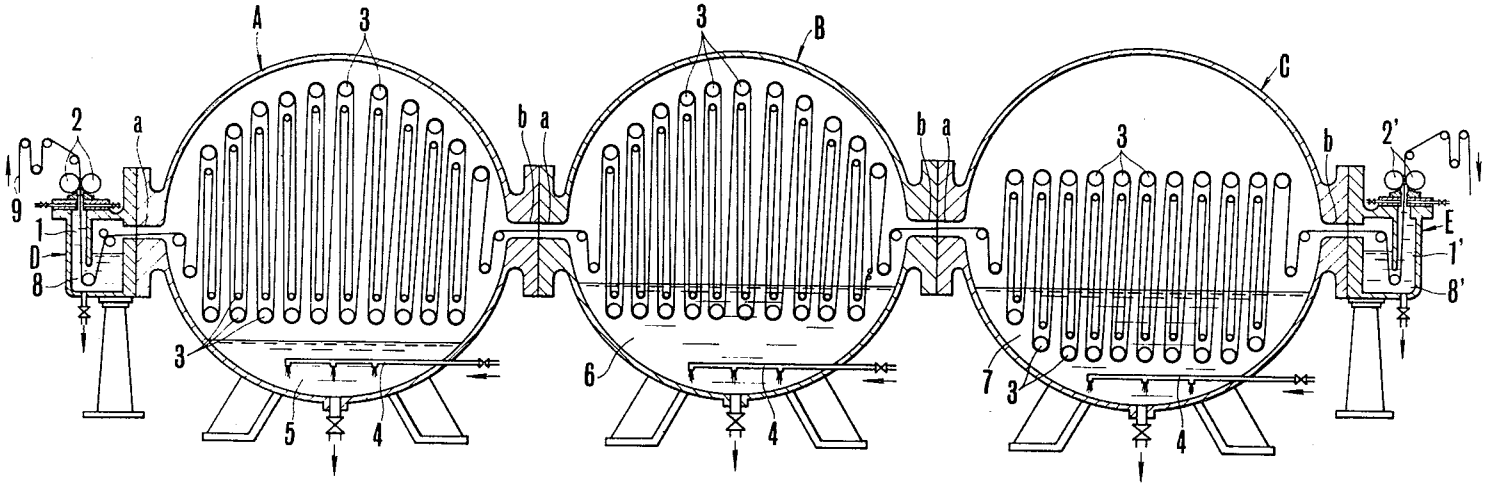

The present invention relates to a method of performing continuous wet heat treatment of a cloth advantageously in the processing thereof, such as in scouring, bleaching, desizing, weight reduction and dyeing. The present inventive method is particularly suitable for dyeing a cloth containing polyester fibers by wet heat treatment.

In dyeing cloths such as woven and knitted goods, for instance, it has been well known that an excellent and high speed dyeing can be done, giving a superior dye fixability, by subjecting a cloth impregnated with a dye solution to a wet heat treatment in a high pressure steamer under high temperature and high pressure water vapor to fix the dye firmly on the cloth, and a discontinuous dyeing method such as a batch process has been adopted therefor conventionally. However, in such a discontinuous method, there are useless features, such as the energy loss in replacing cloth and the loss of dye solution. Particularly, in a commercial mass production, the replacement of cloth in a batch consumes largely labor and cost, and moreover, uniform dyeing cannot be expected.

Under such circumstances, a high pressure steamer for continuous use has been developed by the present applicant, in which a cloth impregnated with a dye solution is transported continuously through the high pressure steamer body by maintaining the interior thereof with a saturated water vapor at about 160° C., and the apparatus is under practical application.

However, since the apparatus is capable of raising the temperature of the interior very high, for instance up to about 160° C. and the wet heat treatment is done at about this temperature, the apparatus becomes a giant one chiefly from the point of the resistance against pressure, and consequently there occur such defects that the construction cost is high, the transportation and establishment of the apparatus are not convenient and a large space is needed for its establishment, thus elevating the fixed costs remarkably.

In the high pressure steamer, further, whereas liquid tanks are provided in the steamer body to take in treating liquids so as to finish the dyeing and preliminary washing of the cloth in the course of transporting the cloth through the steamer body, the size of a liquid tank is unavoidably restricted in a steamer body with a limited space and consequently boiling treatment and particularly preliminary washing can hardly be done sufficiently in situ in the steamer body, so that there occurs such a drawback that it needs a a large amount of water and a prolonged time in washing the cloth after it is taken out from the steamer.

SUMMARY OF THE INVENTION

Accordingly, the present invention is to eliminate such drawbacks in the conventional method of the wet heat treatment of a cloth in a high pressure steamer. The object of the present invention is to disclose a suitable method for the wet heat treatment of a cloth in the processing thereof, particularly in dyeing, at a relatively lower temperature of about 130° C. and a lower pressure of 2.7 kg/cm$^2$ which has been done at a temperature about 160° C. conventionally. Another object of the invention is the development of small high pressure steamer bodies so as to render a compact structural arrangement and to reduce the construction cost and the transportation cost thereof.

The essential point of the present inventive method is to transport a cloth continuously through a plurality of steamer bodies having different functions and connected directly with each other. Different processing steps such as desizing, scouring, weight reduction, dyeing and washing can be done in each of the steamer bodies separately under high temperature and high pressure saturated water vapor with no need of taking out the cloth from the steamer every time. Accordingly, the processing of a cloth under wet heat, which has been done at a high temperature of about 160° C. in the conventional method, can be done quite conveniently and effectively under a saturated water vapor at a temperature as low as about 130° C. in a single high pressure steamer without lowering the processing speed.

In carrying out the method a plurality of small high pressure steamer are used, which may have different functions, to transport a cloth continuously therethrough, the steamer bodies being composed of universal units arranged transversely, provided respectively with a cloth inlet and a cloth outlet situated at the same level and connected directly with each other by joining the cloth inlet and cloth outlet of the adjacent steamer bodies, and with the cloth inlet and the cloth outlet located at the opposite ends of the combined steamer bodies each having a seal mechanism to prevent the leakage of water vapor from the steamer bodies while allowing the passage of the cloth therethrough.

A modification of the present invention comprises dividing the high pressure steamer bodies into at least one steamer body for preliminary wet heat treatment of a cloth and two or more steamer bodies for final wet heat treatment thereof with the intermediation of a pair of cloth inlet and outlet seal mechanisms of the adjacent steamer bodies. This apparatus is particularly suitable for dyeing a cloth containing polyester fibers continuously by wet heat treatment to render the surface of the cloth rough by the preliminary wet heat treatment.

DETAILED EXPLANATION OF THE PREFERRED EMBODIMENTS

The embodiments of the present invention will be explained in detail in the following according to the drawings showing the examples of the inventive apparatus.

Figure 2:
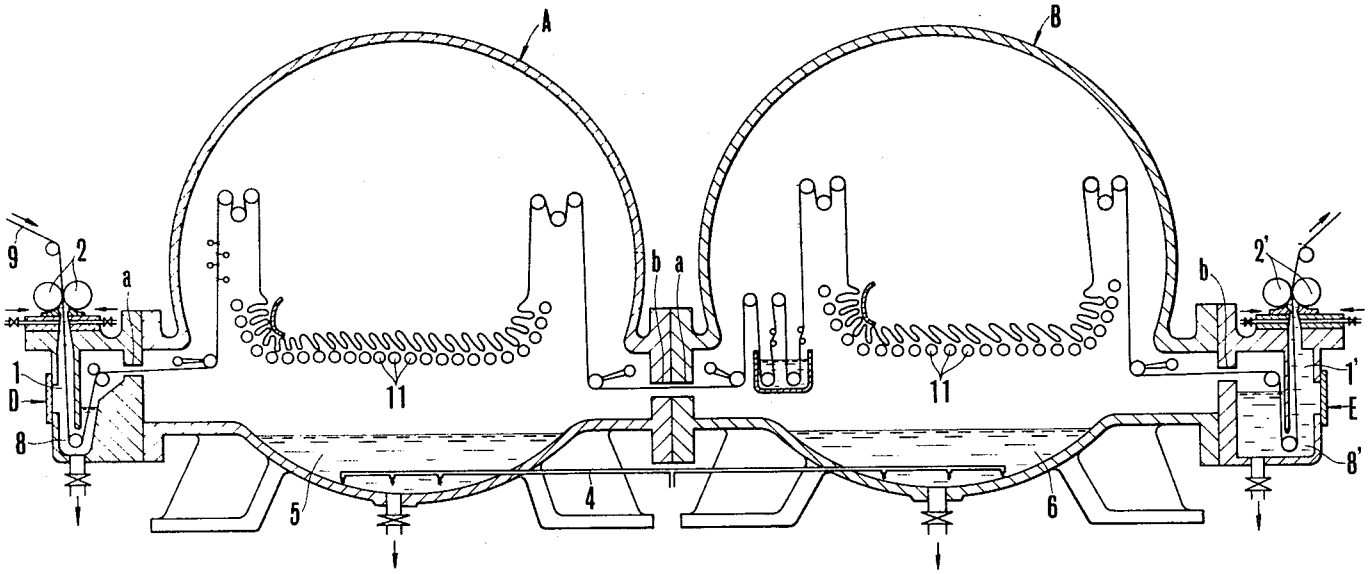
Figure 3:
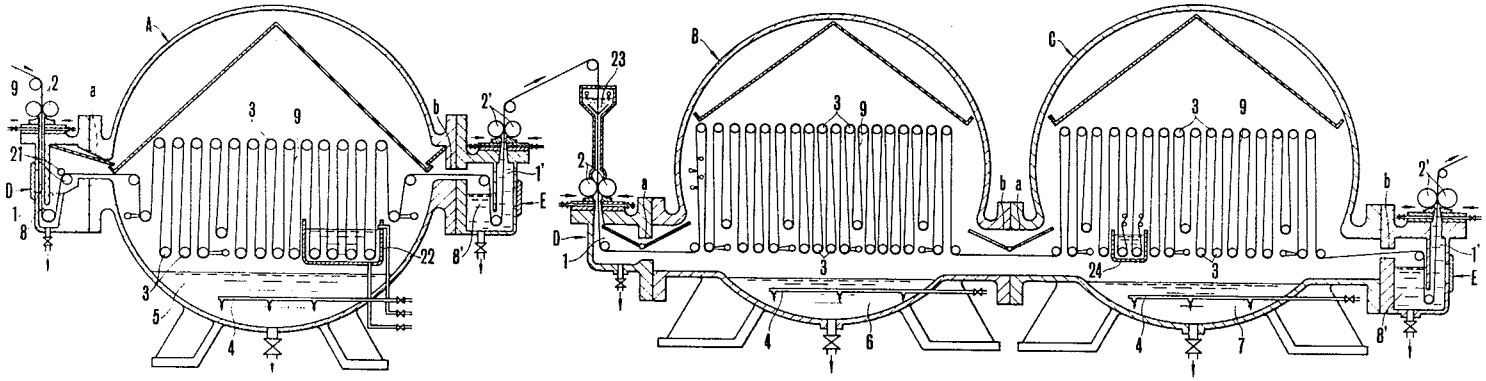

FIG. 1 is an example of the present invention for continuous wet heat treatment of a cloth, FIG. 2 is another example thereof, and FIG. 3 is a further example thereof particularly suitable for dyeing a cloth containing polyester fibers, all the figures showing the explanatory side view of the apparatus.

In the drawings, A, B and C are steamer bodies, a is an inlet, b is an outlet, D is an inlet side seal mechanism, E is an outlet side seal mechanism, 1 and 1' are cloth passages, 2 and 2' are seal rolls, 3 is a guide roll, 4 is a steam pipe, 5, 6 and 7 are liquid reservoirs, 8 and 8' are liquid tanks, 9 is a cloth to be processed, 11 is a roll conveyor, note FIG. 2, and in FIG. 3 21 is a squeeze roll, 22 is a washing tank, 23 is a liquid tank and 24 is also a liquid tank.

In FIG. 1, A, B and C are small high pressure steamer bodies arranged in the transverse direction. They are provided respectively with an inlet a and outlet b to transport a cloth 9 continuously through the steamer bodies. The forms of the steamer bodies A, B and C are universal, and their inlets a and outlets b are situated at the same level with a universal form, so that the connection of the steamer bodies can be done quite simply.

D is an inlet side seal mechanism for the steamer body provided at the inlet of the steamer bodies A, the first member of the steamer bodies, to pass a cloth continuously through the steamer bodies by preventing the leakage of high temperature and high pressure water vapor from the steamers. The inlet side seal mechanism D comprises a nearly U-shaped cloth passage 1 communicated to the inlet a and a pair of seal rolls 2 to seal the outer opening of the cloth passage 1, and the cloth passage 1 is provided with a liquid tank 8 at the lower part thereof to fill a liquid such as a caustic alkali solution, dye solution and water to liquid seal the cloth passage and to impregnate the cloth with the liquid. E is an outlet side seal mechanism provided at the outlet of the steamer body C, the end member of the steamer bodies, having the same construction and function as the inlet side seal mechanism D. The liquid tank 8' in the cloth passage 1' is usually filled with water to liquid seal the cloth passage 1' and to cool the treated cloth slowly. The construction of the seal mechanisms D and E is not limited to the one as illustrated in the above. Various seal mechanisms such as those proposed by the present applicant can freely be adopted according to circumstances, but the details of their constructions are not disclosed because such are outside the scope of the present invention.

3 are guide rolls provided alternately at the upper and the lower parts of each of the steamer bodies A, B and C to transfer a cloth 9 up and down zigzag continuously to lengthen the path of the cloth and to prolong the stay period thereof in the steamer.

4 is a steam pipe to supply high temperature and high pressure water vapor to the lower part of each of the steamer bodies to elevate the water vapor therein to a temperature about 130° C. Thus, the cloth is wet heat treated with the aid of saturated water vapor at about 130° C. in the steamer bodies.

The lower parts of the steamer bodies A, B and C serve respectively as liquid reservoirs 5, 6 and 7, which may take in not only water but also different kinds of treating liquid, such as caustic alkali solution and a detergent solution up to a depth to immerse the guide rolls 3 provided at the lower part of the steamer body therein for the purpose to carry out different kinds of liquid treatment of a cloth together with the wet heat treatment thereof in respective steamer bodies.

As above mentioned, the example of the present invention shown in FIG. 1 comprises three high pressure steamer bodies A, B and C connected directly with each other by joining the cloth outlet b of the steamer body A to the cloth inlet a of the steamer body B and the cloth outlet b of the steamer body B to the cloth inlet a of the steamer body C, and provided with a seal mechanism D at the cloth inlet a of the steamer body A and a seal mechanism E at the cloth outlet b of the steamer body C.

Thus, such apparatus comprises three steamer bodies connected directly with each other, both end openings thereof being provided respectively with a seal mechanism, and the interior of the steamer bodies connected with each other is maintained with saturated water vapor at higher temperatures, so that a cloth transferred into the steamer through the seal mechanism D is wet heat treated sufficiently at a temperature about 130° C. and taken out from the steamer through the seal mechanism E.

Moreover, since the liquid reservoirs 5, 6 and 7 provided respectively at the lower parts of the steamer bodies A, B and C can take up different processing liquid, it is possible to perform different kinds of wet heat treatment in one steamer continuously, and simultaneously, respective liquid treatment can also be done in each of the steamer bodies to accelerate the processing sufficiently and effectively. As a result, the temperature of saturated water vapor necessary for the respective wet heat treatment can be lowered to about 130° C.

In accordance with the object of processing, the number of steamer bodies to be connected with each other may optionally be selected. Even when the number of steamer bodies is increased, it is sufficient to provide only a pair of seal mechanisms quite economically. Since the steamer bodies are small and unified, the apparatus is compact and its transportation and establishment are easy. Thus, the economy of the steamer in total is largely elevated, and the merit of the present invention is very distinguished.

An example of the wet heat treatment of a cloth by using the apparatus illustrated in FIG. 1 will be described for the case of scouring.

A cloth 9 composed of cotton fibers is transported continuously through the steamer bodies A, B and C heated at about 130° C. by passing high temperature and high pressure steam therein through the steam pipe 4. The liquid tanks 8 and 8' as well as the liquid reservoir 5 is filled with water. The liquid reservoir 6 is filled with a caustic alkali solution and the liquid reservoir 7 is filled with a detergent solution, respectively up to a depth to immerse the lower guide rolls 3 to perform liquid treatments simultaneously.

Steaming is done in the steamer body A, boiling and steaming are done simultaneously in the steamer body B to scour the cloth because the cloth is immersed repeatedly in the caustic alkaki solution, and preliminary washing is done in the steamer body C by repeating the immersion of the cloth in the detergent solution. The cloth, cooled slowly as it passes through the liquid tank 8' filled with water, is taken out from the steamer. Thus, the scouring of a cloth can be done quite eminently, and since preliminary washing has been done in the steamer, the finish washing of the cloth can be done quite easily outside the steamer.

The apparatus shown in FIG. 2 comprises two steamer bodies A and B. In this instance, a roll conveyer 11 is provided in each of the steamer bodies instead of guide rolls 3 in FIG. 1. The use of a roll conveyer enables the wet heat treatment of a cloth in a no-tension state, so that the apparatus of this example is particularly beneficial for the processing of expandable cloths such as knitted goods.

FIG. 3 shows a modification of the invention being particularly suitable for the dyeing of a cloth containing polyester fibers, in which three high pressure steamer bodies A, B and C in FIG. 1 are divided into a steamer body A for the preliminary wet heat treatment of a cloth and two steamer bodies B and C for the final wet heat treatment thereof with the intermediation of the outlet side seal mechanism E of the steamer body A and the inlet side seal mechanism D of the steamer body B.

21 is a squeeze roll to squeeze the cloth impregnated with a liquid in the liquid tank 8. A liquid tank 23 provided at the top of the seal roll 2 of the inlet side seal mechanism D of the steamer body B corresponds to the liquid tank 8 provided at the lower part of the cloth passage 1 in the other instances, and the role thereof is the same as before. A liquid tank 22 in the steamer body A and a liquid tank 24 in the steamer body C are to take in a suitable treating liquid for the liquid treatment in situ in the steamer body.

An example of dyeing a cloth containing polyester fibers by using the apparatus in FIG. 3 will be illustrated in the case of a cloth composed of mixed yarns of polyester fibers and cotton fibers.

The cloth 9 is passed continuously through the inlet side seal mechanism D of the steamer body A, where the cloth is impregnated with a caustic alkali solution stored in the liquid tank 8. The cloth is squeezed lightly to remove excess caustic alkali solution by the use of the squeeze roll 21 and enters in the steamer body A maintained at a temperature about 130° C. under high temperature and high pressure saturated water vapor. In the former half of the steamer body A, the cloth is wet heat treated to render the surface of the cloth rough previously for improving the fixability of dye on the cloth, because the surface of a polyester fiber if smooth and has a poor absorption power of a dye solution. In the latter half of the steamer body A, the thus roughened cloth is soaked repeatedly in water stored in the liquid tank 22, and the cloth is washed and wet heat treated to remove caustic alkali solution from the cloth. The cloth is then slowly cooled by passing through the liquid tank 8' in which water is stored, and taken out from the steamer body A continuously in a state having a sufficient surface roughness and a desired feeling.

The cloth 9, whose dye fixability is improved by the pretreatment, is passed continuously through the liquid tank 23 provided at the top of the seal roll 2 of the steamer body B and impregnated with a mixed solution of a disperse dye and a reactive dye stored therein. By the wet heat treatment in the steamer body B at about 130° C., the disperse dye is fixed firmly on the polyester fibers of the cloth.

The cloth is then transported continuously through the steamer body C by impregnating with a reducing agent solution stored in the liquid tank 24 in the meanwhile. By the reducing wet heat treatment in the steamer body C at about 130° C., the reactive dye is fixed on the cotton fibers to finish the dyeing of the cloth eminently. The cloth is cooled slowly in passing through the liquid tank 8' at the outlet of the steamer body C in which water is stored, and taken out continuously from the high pressure steamer in a state having a desired feeling.

Thus, the dyeing of a cloth containing polyester fibers can be done skillfully and satisfactorily at a relatively lower temperature of about 130° C. in a compact apparatus without lowering the treating speed of the cloth as compared with the case of the conventional wet heat treatment which has been done at a higher temperature of about 160° C. Moreover, since the wet heat treatment is done at about 130° C., there is no danger of deteriorating the reducing agent which occurs frequently at about 160° C.

As explained in detail in the above, since the present invention utilizes a plurality of universal type small steamer bodies, the apparatus in total is compact and its construction is easy and simple. Thus, the present invention is quite economical. Continuous wet heat treatment of a cloth, particularly the dyeing of a cloth containing polyester fibers by wet heat treatment, can be done at a relatively lower temperature of about 130° C. smoothly and satisfactorily with a high speed. The present inventive method is very excellent and beneficial for the wet heat treatment of a cloth in the processing thereof.

What is claimed is:

1. A method of continuously effecting a wet heat treatment of a cloth containing polyester fibers in the dyeing thereof comprising impregnating a cloth with a caustic alkali solution, transporting the cloth impregnated with the caustic alkali solution continuously through at least one high pressure steamer body under a saturated water vapor at about 130° C. for a preliminary wet heat treatment to render the surface of the cloth rough, impregnating the thus treated cloth with a dye solution, and then transporting the resultant cloth through two or more high pressure steamer bodies having different functions and directly communicating with each other under a saturated water vapor at about 130° C. for a final wet heat treatment to fix the dye on the cloth and to finish the cloth.

* * * * *